US005296286A

United States Patent [19]

Allen et al.

[11] Patent Number: 5,296,286

[45] Date of Patent: Mar. 22, 1994

[54] PROCESS FOR PREPARING SUBDENIER FIBERS, PULP-LIKE SHORT FIBERS, FIBRIDS, ROVINGS AND MATS FROM ISOTROPIC POLYMER SOLUTIONS

[75] Inventors: Steven R. Allen, Midlothian, Va.; David M. Gale; Aziz A. Mian, both of Wilmington, Del.; Sam L. Samuels, Claymont, Del.; Hsiang Shih, Wilmington, Del.

[73] Assignee: E. I. Du Pont de Nemours and Company, Wilmington, Del.

[21] Appl. No.: 961,704

[22] PCT Filed: Jul. 19, 1991

[86] PCT No.: PCT/US91/05000

§ 371 Date: Jan. 11, 1993

§ 102(e) Date: Jan. 11, 1993

[87] PCT Pub. No.: WO92/01829

PCT Pub. Date: Feb. 6, 1992

Related U.S. Application Data

[63] Continuation-in-part of Ser. No. 555,194, Jul. 20, 1990, abandoned, which is a continuation-in-part of Ser. No. 304,461, Feb. 1, 1989, Pat. No. 4,963,298.

[51] Int. Cl.[5] ..... D03D 3/00

[52] U.S. Cl. ..... 428/224; 162/146; 162/157.3; 264/12; 264/14; 264/141; 264/178 F; 264/180; 264/181; 264/184; 264/200; 264/517; 264/518; 428/364

[58] Field of Search ..... 162/146, 157.3; 428/224, 364; 264/12, 14, 517, 518, 141, 178 F, 180, 181, 184, 200

[56] References Cited

U.S. PATENT DOCUMENTS

| | | | |
|---|---|---|---|
| 3,441,473 | 4/1969 | Brundige et al. | 162/146 |
| 3,849,241 | 11/1974 | Butin et al. | 156/167 |
| 4,013,744 | 3/1977 | Huerten et al. | 264/14 |
| 4,189,455 | 2/1980 | Raganato et al. | 264/140 |
| 4,818,463 | 4/1989 | Buehning | 264/40.1 |
| 4,963,298 | 10/1990 | Allen et al. | 264/12 |

FOREIGN PATENT DOCUMENTS

| | | |
|---|---|---|
| 166830 | 4/1984 | European Pat. Off. . |
| 0244217 | 7/1987 | European Pat. Off. . |

*Primary Examiner*—James J. Bell

[57] ABSTRACT

A process for preparing subdenier fibers and structures thereof from isotropic polymer solutions is disclosed. The process comprises extruding a stream of the polymer solution into a chamber, introducing a pressurized gas into the chamber, directing the gas in the flow direction of and in surrounding contact with the stream within the chamber, passing both the gas and the stream into a zone of lower pressure at a velocity sufficient to attenuate the stream and fragment it into fibers, and contacting the fragmented stream in the zone with a coagulating fluid.

22 Claims, 4 Drawing Sheets

PLOT

PROCESS FOR PREPARING SUBDENIER FIBERS, PULP-LIKE SHORT FIBERS, FIBRIDS, ROVINGS AND MATS FROM ISOTROPIC POLYMER SOLUTIONS

This application is a continuation-in-part of U.S. patent application Ser. No. 07/555,194, filed Jul. 20, 1990 abandoned, is in turn a continuation-in-part of U.S. patent application Ser. No. 07/304,461, filed Feb. 1, 1989 now U.S. Pat. No. 4,963,298.

BACKGROUND OF THE INVENTION

1. Field of the Invention

The present invention relates to a process for preparing subdenier fibers from isotropic polymer solutions which may be collected in the form of pulp-like short fibers, fibrids, rovings, and mats. The invention also contemplates and includes products having novel subdenier fiber structures which are produced according to the aforementioned process.

2. Description of the Prior Art

Different methods are known in the art for preparing sheet structures and non-woven articles of discontinuous thermoplastic fibers.

For example, Butin et al., U.S. Pat. No. 3,849,241, and European Publication 0166830, disclose directing gas streams at a fiber-forming polymer in the molten state and then collecting the fibers on a screen.

It is also known in the art to flash extrude a continuous fibrillated polymeric structure and to shred it by directing a stream of fluid against the structure at the moment of its formation. (See, Raganato et al., U.S. Pat. No. 4,189,455).

However, none of the foregoing references disclose a jet-attenuating process for preparing subdenier fibers from isotropic solutions.

Morgan, U.S. Pat. No. 2,999,788 describes the preparation of fibrids of various synthetic organic polymers and their use in making synthetic sheet structures, such as papers. Such papers, when prepared from poly(meta-phenylene isophthalamide) fibrids, are useful in electrical applications, especially when combined with poly(-meta-phenylene isophthalamide) short fibers (floc). As disclosed by Gross, U.S. Pat. No. 3,756,908, the poly(-meta-phenylene isophthalamide) fibrids of the art are filmy particles which act as a binder for the floc and impart good electrical properties. However, these fibrids have a deficiency in that they seal the papers excessively and so act to reduce porosity. Porosity is a valuable property because it facilitates coating and saturation of the papers with varnishes and resins, a method well known in the art to modify and improve properties of electrical papers.

An object of the present invention is to prepare new pulp-like poly(meta-phenylene isophthalamide) fibrids. These pulp-like fibrids may be used to prepare sheet structures, such as papers which demonstrate improved porosity and electrical properties. These sheet structures may be used in preparing laminate and composite structures.

SUMMARY OF THE INVENTION

This invention provides a process for preparing subdenier fiber from isotropic polymer solutions. The process comprises 1) extruding a stream of an isotropic solution of a polymer through a spinneret orifice into a chamber, 2) introducing a pressurized gas into said chamber, 3) directing the gas in the flow direction of and in surrounding contact with said stream within the chamber, 4) passing both the gas and stream through an aperture into a zone of lower pressure at a velocity sufficient to attenuate the stream and fragment it into fibers, and 5) contacting the fragmented stream in said zone with a coagulating fluid. A suitable gas for contacting the extruded stream in the chamber is air and the zone of lower pressure wherein both the gas and stream pass may be air at atmospheric pressure. Preferably, the coagulating fluids are water, dimethylsulfoxide or dimethylacetamide.

Preferred embodiments of the present invention include spinning isotropic polymer solutions of polyacrylonitrile, poly(m-phenylene isophthalamide), a copolymer of 3,4'-diaminodiphenyl ether and isophthaloyl-bis-(caprolactam), and a mixture of poly(m-phenylene isophthalamide) and a copolymer of 3,4'-diaminodiphenyl ether and isophthaloyl-bis-(caprolactam).

The fragmented stream of subdenier fibers may be collected in the form of pulp-like short fibers, fibrids, rovings, or mats, and such products are contemplated as part of the present invention.

In one embodiment of the invention, poly(m-phenylene isophthalamide) pulp-like fibrids are produced by spinning a polymer solution comprising about 12 to 19% by weight poly(m-phenylene isophthalamide) polymer. Hot air having a pressure equal to or greater than about 6 $kg/cm^2$ is introduced into the chamber. Suitable solvents for the poly(m-phenylene isophthalamide) polymer include dimethylacetamide, and a mixture of dimethylacetamide and dimethylsulfoxide.

The invention also includes pulp-like fibrids produced from such a process. These pulp-like fibrids have a diameter of about 0.1 to 50 micrometers, a length of about 0.2 to 2 millimeters, and a freeness value of about 100 to 2000 milliliters, wherein the fibrids are capable of forming 100% by weight poly(m-phenylene isophthalamide) porous sheets. These wet-laid porous sheets preferably have a porosity of about 0.1 to 200 seconds, and more preferably from about 0.1 to 2.0 seconds, per 100 cubic centimeters. These sheets have a dielectric strength equal to or greater than about 300 volts per ounce per square yard, and typically between about 300 to 700 volts.

Wet-laid sheets comprising about 5 to 95% by weight of the above poly(m-phenylene isophthalamide) pulp-like fibrids are also contemplated. These wet-laid sheets may comprise a composition of the pulp-like fibrids, poly(m-phenylene isophthalamide) film-like fibrids, and poly(m-phenylene isophthalamide) staple floc.

DETAILED DESCRIPTION OF THE INVENTION

Figure 1:
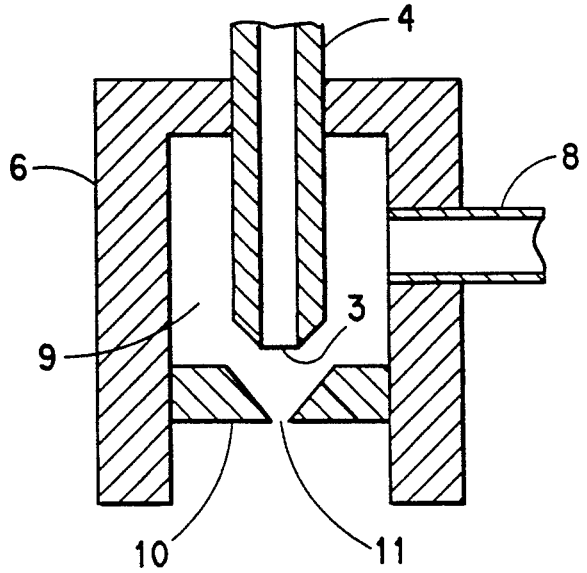
FIGS. 1–6 are cross-sectional schematic views of apparatus, primarily spin-cells, for practicing the invention.

Several isotropic polymer solutions which are well known in the art may be used in the present invention. These solutions include: nylon 66 in sulfuric or formic acid, polyacrylonitrile, for example, co- and ter-polymers of acrylonitrile, methyl acrylate, and DEAM (diethylaminoethyl methacrylate) in dimethylsulfoxide, dimethylacetamide, or dimethylformamide solvents; polyether-ureaurethane polymers, for example, a polymer made from the reactants, polytetramethylene glycol, methylene-bis-(p-phenylene isocyanate), ethylene diamine, and 1,3-cyclohexane diamine in dimethylacetamide solvent; polyimides, for example, a terpolymer of oxydianiline, hexafluoropropylidene-bis-phthalic anhydride and sulfone dianiline in N-methylpyrrolidone solvent; melt-processable aramids, for example, copolymers of 3,4'-diaminodiphenyl ether and isophthaloyl-bis-(caprolactam) in sulfuric acid; poly(m-phenylene isophthalamide) in dimethylacetamide; and polyvinylidene fluoride in dimethylacetamide. Other suitable fiber-forming isotropic polymer solutions which are well known in the art may also be used. If desired, more than one polymer may be incorporated in the same isotropic solution to form suitable polymer blends. The isotropic polymer solutions used in this invention may be prepared by techniques known in the art.

The isotropic polymer solution is extruded through a spinneret orifice into a chamber in the vicinity of a generally convergent-walled aperture through which it will exit the chamber. A pressurized gas which is inert to the isotropic polymer solution, is introduced into the chamber also in the vicinity of the aperture and in surrounding contact with the solution stream. The gas, preferably air, is at a pressure between 1.7 kg/cm$^2$ and 7.2 kg/cm$^2$ and is at a temperature from 20° to 300° C. as it is fed into the chamber. The velocity of the gas is such as to attenuate and fragment the stream as it exits the chamber through the aperture.

The gas and stream upon leaving the chamber, enter a zone of lower pressure, preferably air, at atmospheric pressure. It is in this zone that the stream is contacted either before or after collection, with coagulating fluid. Examples of suitable coagulating fluids include water, alcohol, and mixed solvents. A variety of products may be obtained depending upon the type of coagulating fluid used, and the method of contacting the stream with the coagulating fluid.

In order to prepare a mat, the fragmented stream is contacted with a jet of coagulating fluid, for example, water, at some distance such as, for example, 15 to 30 cm from the aperture. The water jet will coagulate and disperse the stream which may then be collected as a mat on a screen belt moving transversely to the dispersed stream. Where the stream comprises an acid solution of polymer, contact with water dilutes the acid and causes the polymer to come out of solution. The collected material may be washed further or neutralized with dilute base, as is known in the art while on the screen belt. The resulting mat is formed by the random laydown of jet-attenuated spun, oriented, subdenier, discontinuous fibers having widely varying morphology. The mat may be tacked at fiber cross-over points to form a dimensionally stable sheet structure.

To make pulp-like product, coagulating fluid is caused to contact the exiting solution stream at the aperture and the product is collected over a pool of coagulating fluid. The pulp-like product consists of short, oriented, subdenier fibers with varying morphology and lengths up to 15.0 mm.

Finally, to make roving or sliver, a jet of coagulating fluid is directed against the fragmented stream at a distance from the aperture between about 1.0 to 10.0 cm and the coagulated product is collected on a relatively fast moving screen; however, in this case, the jet employed is one that lacks sufficient force to disperse the coagulated product before it is collected. The structure of the coagulated product is an essentially unidirectional laydown of oriented, subdenier, discontinuous fibers having widely varying morphology with essentially no tacking or bonding between fibers.

A more detailed description of suitable apparatus and methods of operation appears below.

FIG. 1 shows, in schematic cross-section, a spin-cell having a tubular 1-hole spinneret (4) with an outlet (3) extending into chamber (9) of cylindrical manifold (6). The manifold has an inlet (8) and a nozzle (10) with a convergent-walled aperture (11) serving as an exit from the cell. In operation, an isotropic solution of polymer is metered through spinneret (4) and into chamber (9) where it is contacted by a pressurized gas introduced from inlet (8). The gas attenuates and fractures the polymer solution into elongated fragments as it passes out of the chamber through aperture (11), whose walls converge into a narrower opening. As the stream of elongated fragments exit aperture (11), they are contacted with a coagulating fluid. A variety of products may be obtained depending upon how the contact is made, and type of coagulating fluid used.

Figure 2:
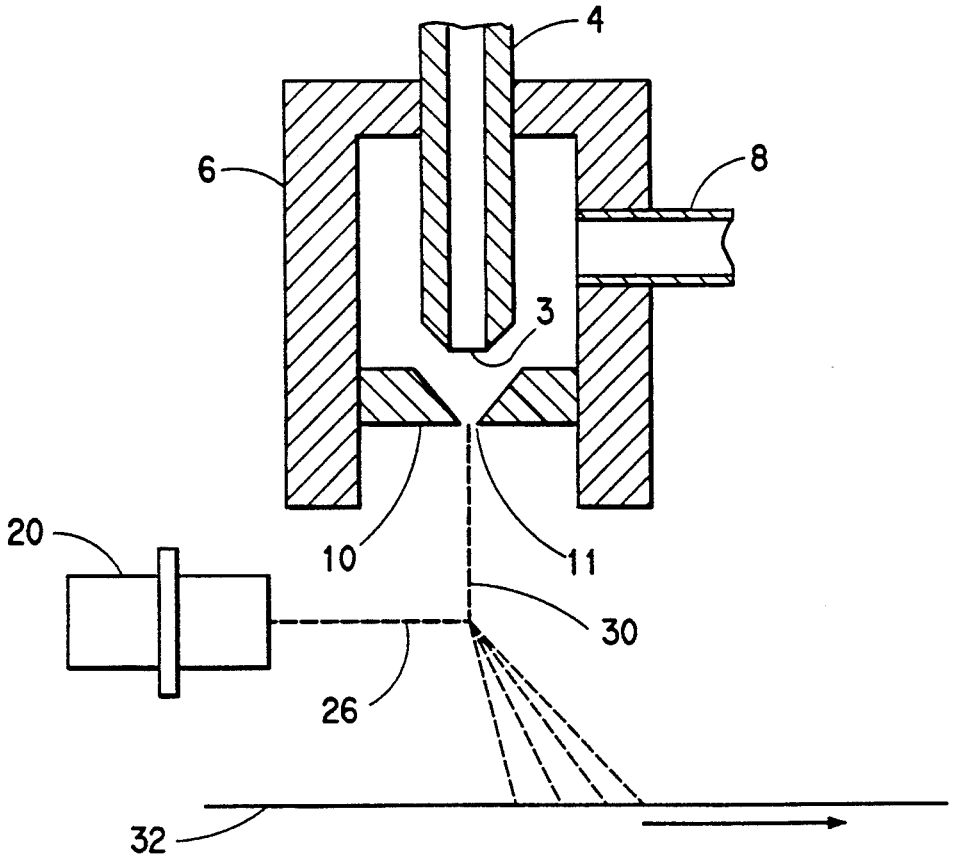

FIG. 2 shows a process wherein the elongated fragments or fibers exiting spin-cell (6) are contacted at a distance below aperture (11) with a fluid (26) from spray jet nozzles (20) which acts to coagulate and spread the fragments of stream (30) which are then deposited as a nonwoven sheet onto moving screen (32). If desired, a sequence of such jets may be employed. These fragments are subdenier fibers with widely different cross sections and have lengths up to 10 cm, diameters up to 10 microns, and length to diameter ratios of at least 1000. The fibers on the screen can be washed, dried and wound onto a bobbin (not shown) in a continuous process.

Figure 3:
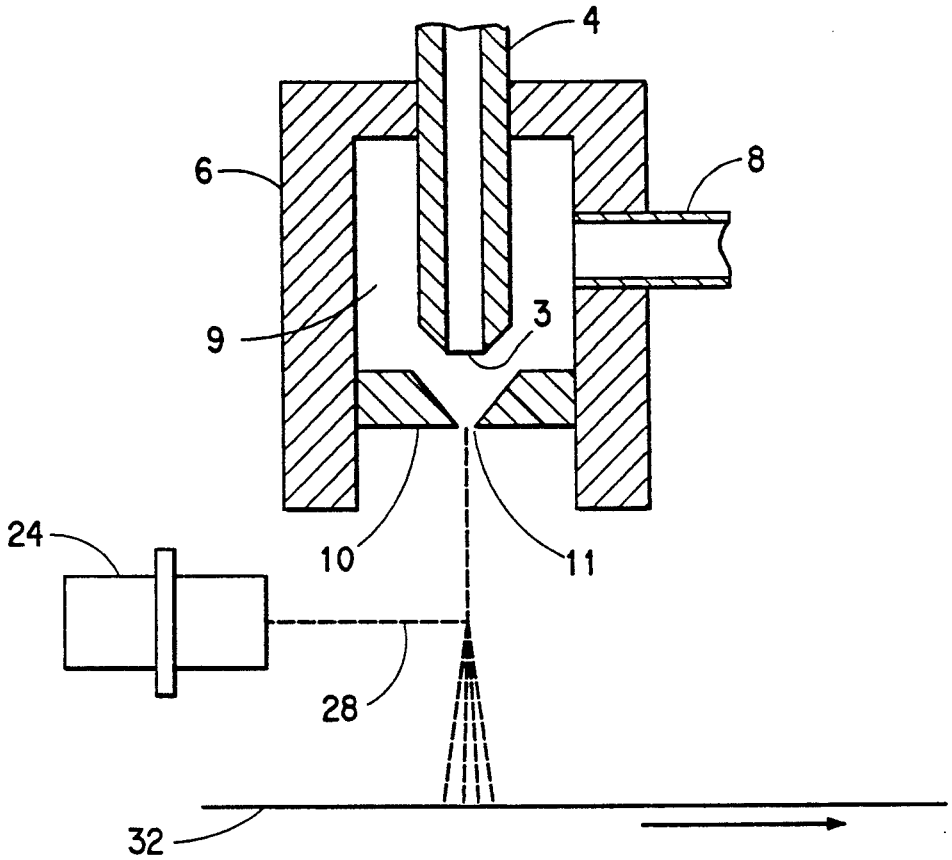

FIG. 3 shows an alternate method for contacting the stream leaving aperture (11) with coagulating fluid to produce roving or sliver. In this case, an atomized jet of coagulating fluid (28) from spray jet nozzle(s) (24) impinges on the stream exiting aperture (11) at a distance up to 10 cm below the aperture. The fibers in the stream have a momentum greater than the atomized jet of coagulating fluid and consequently deflection of the stream and dispersal of the fibers is low. Under these conditions, the subsequent fiber deposition on the moving screen (32) is essentially unidirectional and the product is suitable for sliver or roving. In an analogous method, the stream exiting aperture (11) may be prevented from spreading by surrounding the stream with a curtain of coagulating fluid flowing in the same direction. The curtain of the coagulating fluid initiates fiber coagulation and prevents spreading.

In either case, the stream containing coagulated fibers is intercepted by a moving screen conveyor belt causing the fibers to lay down essentially unidirectionally over the screen. The sliver or roving which forms can be wrapped on a bobbin (not shown). The fibers are similar to those of the previously described nonwoven mat.

Figure 4:
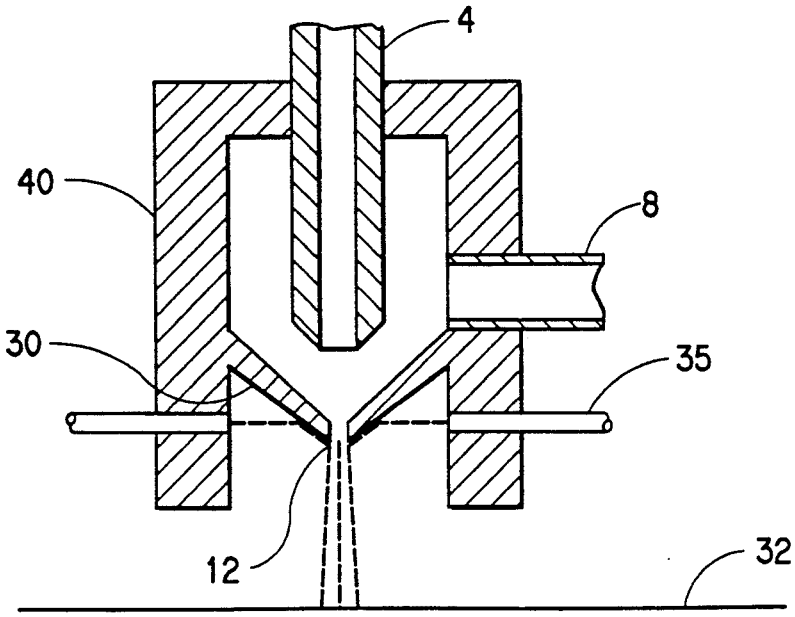

FIG. 4 shows a method for producing pulp-like short fibers. FIG. 4 shows spin-cell (40) which is similar to that of FIG. 1, except for having a conical nozzle (30) and a jet (35) which is built into the spin cell housing. Coagulating fluid from jet (35) is impinged on the outer surface of nozzle (30) and trickles down the slope of nozzle (30) to aperture (12) and contacts the exiting stream. This method results in formation of pulp-like short length coagulated fragments which can be spread over a moving screen or recovered in a receptacle (not shown) located below the spin-cell.

Figure 5:
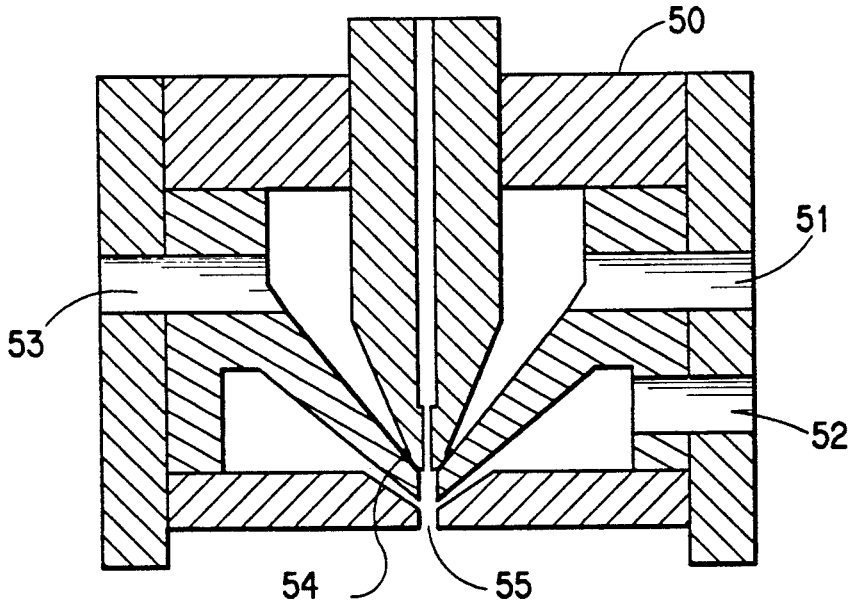

FIG. 5 shows a spin-cell (50) with inlet (51) for admitting hot air to heat the spinneret to prevent plugging while inlet (52) admits cold processing air to be introduced at the second stage. Seal (54) prevents the hot air from mixing with the cold air in the spin cell. Spent hot air may be removed from the chamber through exit (53). Polymer solution and cold air leave through exit aperture (55).

Figure 6:
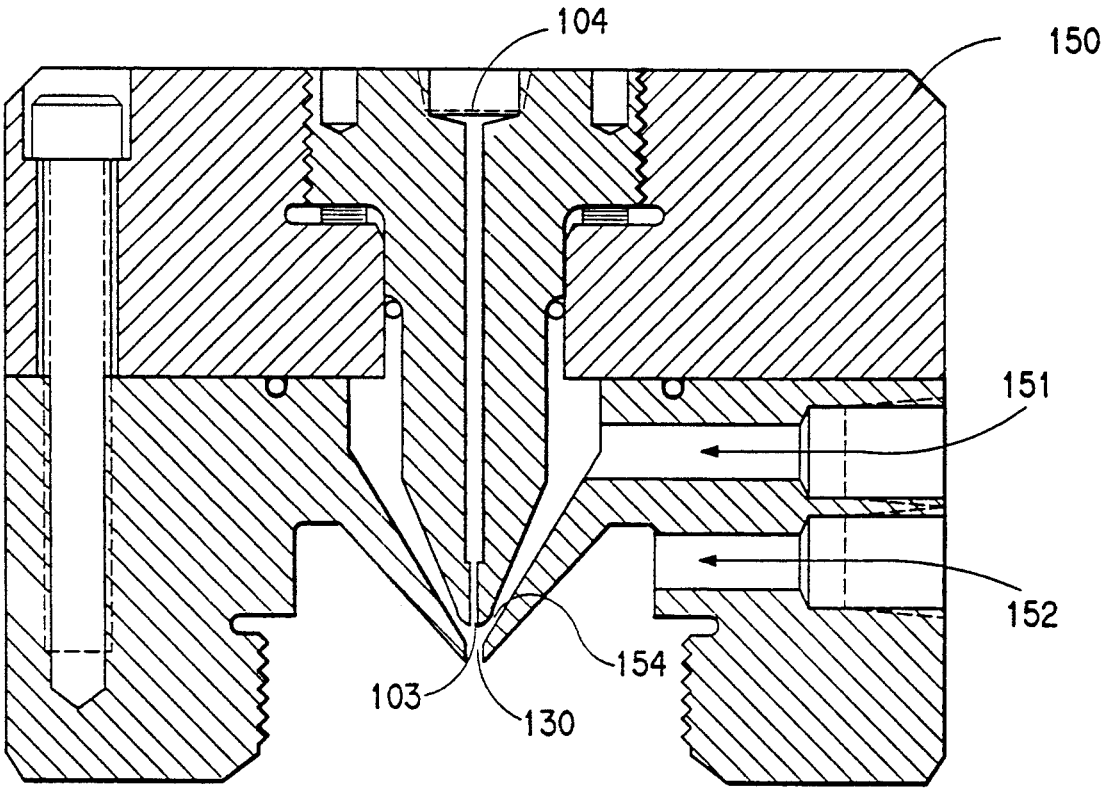

FIG. 6 shows a spin-cell (150) with inlet (151) for admitting hot air which heats the spinneret (104) to facilitate the flow characteristics of solutions. The hot air then passes through a narrow ringlet gap (154) before exerting drag force on the extruded solution at the outlet of the spinneret (103). The air attenuates and fractures the filaments as it passes out of the chamber through the aperture (130). The aperture (130) is a constant diameter opening of finite length. As the fractured filaments exit aperture (130), they are immediately contacted with coagulating fluid, which enters the aperture area through opening (152). For production of loose samples of pulp-like fibrids, the polymer solution, exiting air and coagulant are collected in a pool of water.

It will be obvious to one skilled in the art that a variety of modifications of the above apparatus may be made. Thus, if desired, a plurality of spin-cells arranged side-by-side in linear fashion may be employed to achieve laydown of uniform sheets of considerable width. Similarly, a diverging channel formed by walls aligned in parallel and positioned at the exit of aperture (11) will cause the exiting stream to spread into a wider stream as it leaves the spinning cells.

There are several important process variables critical for making high quality pulp-like fibrids using the process of the current invention, especially if these fibrids are to have properties needed for the production of improved porous papers. Preferably, a spinneret arrangement similar to that shown in FIG. 6 is used. The important process variables include solution viscosity, solution extrusion rate, pressure of hot air entering the cell, opening of the air aperture (130), and length of the air gap (measured as the distance between the outlet of the spinneret (103) and the outlet of the aperture (130)).

Solution viscosity is controlled by the solution temperature and polymer concentration in the solution. For work described herein, solution viscosity was controlled through the adjustment of polymer concentration. Solution extrusion rate was controlled by nitrogen back pressure applied to generate the forward movement of the solution. Air pressure can be readily adjusted through a regulator.

Polymer concentration in poly(m-phenylene isophthalamide) solutions (in dimethylacetamide/dimethylsulfoxide solvent) was varied between about 12 weight % and 19 weight % to study the effect of solution viscosity on the quality of the pulp-like fibrids. The fibrid diameter decreases with decreasing solution viscosity, whereas the concentration of large particle defects increases dramatically at the lower polymer concentrations. To achieve the goal of obtaining the finest diameter fibrids with minimum amount of particle defects, 16 wt. % solids solution was determined to give the best results. Optimum polymer concentration will vary with the specific polymer/solvent combination being used. Other possible solvents for poly(m-phenylene isophthalamide) polymer are known in the art and include dimethylacetamide by itself.

Solution extrusion rate was controlled by nitrogen back pressure. High nitrogen pressure results in high extrusion rate which is preferred from productivity considerations, however, it is often accompanied by a high concentration of large particle defects. For 16 weight % solutions of poly(m-phenylene isophthalamide) (MPD-I) spun using a 0.004 inch (0.102 mm) spinneret, a nitrogen back pressure of no greater than 500 psig was required, and preferably no greater than 400 psig, in order to achieve high quality pulp-like fibrids.

Air pressure determines the air velocity and velocity changes near the capillary and the aperture. It was found from this work that the best fibrid quality was obtained when air pressure was set at its highest possible setting which is about 80 psig (6.65 kg/cm$^2$) for the apparatus shown in FIG. 6 having the dimensions described in Examples 6–16.

The pulp-like MPD-I fibrids of the current invention have different characteristics and properties than fibrids known in the art. For example, fibrids of MPD-I that are described in the art are flat, filmy materials, with typical dimensions of 0.1 micrometers thick, 100 micrometers wide, and refined to various lengths The filmy nature of these fibrids results in sealing of papers containing them, which results in low porosity.

In contrast, the improved pulp-like fibrids of the current invention have a basically round cross-section, with an irregular, fibrillar morphology. Unlike filmy fibrids of the art, the pulp-like MPD-I fibrids of the current invention have a refined fibrid look, openness, and paper-making capability, without having to refine them. The pulp-like fibrids of the current invention do not result in sealing of papers containing them. Therefore, when the pulp-like fibrids comprising aromatic polyamides such as MPD-I, are used to make electrical papers, an improved combination of electrical properties and porosity is achieved versus similar papers in the art which incorporate filmy fibrids.

In electrical paper or other high quality paper end-uses, preferable dimensions for the pulp-like fibrids are 0.1–50 micrometers in diameter and 0.2–2.0 mm in length. More preferably, the pulp-like fibrids have diameters of 0.2–5.0 micrometers and lengths of 0.2–1.3 mm. The pulp-like fibrids of the current invention also have high freeness values. It is preferred that the freeness values, measured on a Schoppler Riegler apparatus, are 100–2000 ml. More preferably, the pulp-like fibrids have freeness values of 500–1000 ml.

The MPD-I pulp-like fibrids of the current invention may be used alone or as blends with filmy fibrids and staple floc to produce papers having good electrical properties. "Staple floc," or "floc," as used herein, refers to fibers in the form of short fibers. Preferably, the floc comprises fibers less than 2.54 cm in length with the optimum length being about 0.6 cm. Appropriate yarns or tows of the polyamide are cut to the desired floc length by any suitable manner, e.g., by the use of a helical saw cutter. Suitable fibers are those having a denier of from about 0.5 and up to 10 or more. Deniers less than about 5 are preferred. Most preferred are fibers having a denier of between about 1 and about 3.

In preparing electrical papers, using blends of the poly(m-phenylene isophthalamide) pulp-like fibrids of the current invention with poly(m-phenylene isophthalamide) filmy fibrids of the art, and poly(m-phenylene) isophthalamide staple floc, the preferred compositions of the blends are: 5–100 weight % pulp-like fibrids, 0–60 weight % filmy fibrids, and 0–90 weight % staple floc. More preferably, 10–60 weight % pulp-like fibrids, 0–33 weight % filmy fibrids, and 10–50 weight % staple floc blends are used.

TESTING PROCEDURES

The sample fibers' denier must be calculated before determining tensile properties. Techniques for measuring the denier of such non-round and varying diameter fibers are known and include Specific Surface Area Measurement, Scanning Electron Microscope Measurement and direct measurement of a sample group of fibers under the optical microscope.

An Instron 1122 was employed for determining tenacity and modulus following ASTM D2101 Section 10.6 (strain<10%). For 1.0 inch sample lengths, the clamps (grips with 6/16 inch×6/16 inch neoprene faces) were set between 1¼ and 1½ inches apart and operated at a crosshead speed of 0.1 inch/min., while for 0.25 inch sample lengths, the clamps were set at 0.75 inch between faces and translated at a crosshead speed of 0.025 inch/min.

Each end of a filament sample was taped to opposite ends of a rectangular tab with a rectangular cut-out (opening) of the specified length (1 inch or 0.25 inch). Taping was at a distance away from the opening and some slack in the fiber was allowed. A drop of adhesive was placed close to the edges of the tab opening to bond the designated length of the filament to correspond to the length of the tab opening. The tab was mounted in the top clamp of the Instron and one side of the tab was cut. The opposite end of the tab was then mounted in the lower clamp and the other side of the tab was cut leaving the filament extended across the gap between the clamps. The Instron was turned on and the stress-strain relationship of the filament was directly fed into the computer which calculated the tensile properties.

Dielectric strength was measured per ASTM D-149.

Porosity was measured using TAPPI test method T 460 om-88 "Air Resistance of Paper." The results of the test are reported in seconds which refers to the number of seconds required for a mass of 567 grams to force 100 cc of air through 6.4 square centimeters (1 square inch) of the paper being tested. The greater the test result number in seconds, the lower the porosity of the paper.

Average fiber length for pulp materials was determined on a Kajaani Model FS 100 instrument per manufacturer's test procedure in "Kajaani FS100 Standard Procedure for Analysis," Document T3501.0-e, Copyright 2 Sep. 1985, Kajaani Electronic Ltd., Kajaani, Finland.

Samples of fibrids were tested for freeness according to the International Organization for Standardization (ISO) Standard ISO 5267/1-1979(E), 'Pulps —Determination of Drainability Part I—Schoppler-Riegler Freeness Tester,' using a pad weight of 2.0 grams and a temperature in the range of about 20° to 25° C.

METRIC CONVERSION TABLE

| TO CONVERT FROM | TO | MULTIPLY BY |
|---|---|---|
| In | cm | 2.54 |
| oz/yd$^2$ | gm/m$^2$ | 33.9 |

The following examples are submitted as illustrative of the present invention and are not intended as limiting. In the following examples, parts and percentages are by weight unless otherwise indicated.

EXAMPLE 1

A 25% solution of a terpolymer of acrylonitrile, having a composition of 91% acrylonitrile, 6% methyl acrylate, and 3% DEAM (diethylaminoethyl methacrylate) with an inherent viscosity of 1.4, in dimethylsulfoxide was prepared. The solution was prepared by placing the polymer powder and solvent in a resin kettle, and then dissolving the polymer in the solvent by agitation. The solution was then pushed hydraulically into a spin cell similar to the one shown in FIG. 4 and spun through a single hole spinneret, according to conditions shown in Table I. The spinneret had a diameter of 0.004 inches (0.1016 mm) and a length to diameter (L/D) ratio of 3.0. Referring to FIG. 4, the spin cell had an air gap of 0.176 inches, (4.47 mm) as measured from the outlet (3) of the spinneret to the narrowest diameter (or throat) of the aperture (12) of the nozzle (30) of the spin cell. The narrowest diameter of the aperture (12) was 0.062 inches 1.57 mm). The convergent wall of the aperture (12) was at an angle of 40 degrees to the spinneret's axis making a conical angle of 80 degrees. Heated air at 80° C. and pressurized at 80 psig (6.7 kg/cm$^2$) was supplied to the spin cell to attenuate and fragment the freshly extruded polymer. The discontinuous fibers leaving the spin cell were contacted with a stream of tap water over a moving screen conveyor belt at a distance of 17.375 inches (44.1 cm) from the tip of the aperture (12) to produce fibers having a length up to 8 cm.

The fibers were laid over a moving screen conveyor belt forming a random web which moved along with the conveyor belt from the spinning chamber to a washing chamber. In this chamber, the web was washed to remove the last traces of solvent and then moved to a drying chamber where the washed web was dewatered, partially dried and then wound up over a bobbin (or roll).

The fibers on the bobbin (or roll) looked like a carded sliver and could possibly be directly used to produce spun yarns. The fibers were tested for physical properties and the results are given in Table I.

TABLE I

POLYACRYLONITRILE FIBERS

| Spinning Soln. | | Attenuating Air | | | Air Jet | Average Fiber Properties (Averaged Over 8 Filaments) | | | | |
|---|---|---|---|---|---|---|---|---|---|---|
| Temp. °C. | Pressure Psig (kg/cm$^2$) | Temp. °C. | Pressure Psig (kg/cm$^2$) | Conveyor Belt Speed meters/min. | Nozzle Diameter inches (mm) | Diameter Avg. Micrometers | Denier Avg. (dtex) | Avg. Tenacity gpd (dN/tex) | Init. Mod. Av. Kpsi (gpd) (dN/tex) | Max. Av. Elong. % |
| 25° | 1200–1400 (85.4–99.5) | 80° | 80 (6.7) | 1.5–2.0 | .062 (1.57) | 3.48 | 0.101 (0.112) | 2.32 (2.05) | 773.82 (51.3) (45.3) | 39.96 |

Alternatively, the discontinuous fibers leaving the spin cell were contacted with a stream of tap water at the tip of the aperture (12) to produce fibers having a length less than 15 mm. These medium length fibers were collected over a pool of water which was later separated from the fibers by a standard filtration method. Finally, the fibers were washed to remove any residual solvent. These fibers may be wet laid to form a paper by using conventional techniques known to the art.

EXAMPLE 2

A 20% solution of poly(m-phenylene isophthalamide) in dimethylacetamide solvent was pushed hydraulically into a spin cell similar to the one shown in FIG. 4 and spun through a single hole spinneret according to the conditions in Table II. The single hole spinneret had a diameter of 0.004 inches (0.1016 mm) and a L/D ratio of 3.0. Alternatively, the single hole spinneret had a diameter of 0.010 inches (0.254 mm) and a L/D ratio of 3.0. The solution was spun from both types of spinnerets.

Referring to FIG. 4, the spin cell had an air gap of 0.176 inches (4.47 mm) as measured from the outlet (3) of the spinneret to the narrowest diameter (or throat) of the aperture (12) of the nozzle (30) of the spin cell. The narrowest diameter of the aperture (12) was 0.062 inches (1.57 mm). The convergent wall of the aperture was at an angle of 40 degrees to the spinneret's axis making a conical angle of 80 degrees.

The discontinuous fibers leaving the spin cell were contacted with a spray of tap water at approximately 11 inches (28 cm) from the tip of the aperture (12) and collected over a moving stainless steel screen. A web of subdenier fibers formed on the screen. Single fibers were tested for physical properties and the results are given in Table II. X-ray analysis of the fibers showed an amorphous structure. The web, washed and dried, can be used as an inner layer to prepare laminates with similar layers of poly(p-phenylene terephthalamide) and can be used for high temperature insulation.

degrees to the spinneret's axis making a conical angle of 80 degrees.

The discontinuous fibers leaving the spin cell were contacted with a spray of tap water at the tip of the aperture (12) and collected over a pool of water (not shown) Fibers were filtered, washed and slurried in water using a "Waring" Blender to further reduce the fiber-length. The product was a sub-denier pulp having fiber length up to 5 mm. These subdenier pulps are useful in making high quality paper, as bonding agents for poly(p-phenylene terephthalamide) papers and as thickening agents.

EXAMPLE 4

A 30% solution of a copolymer of (3,4'-diamino diphenyl ether and isophthaloyl-bis-(caprolactam) was prepared by dissolving the copolymer in dimethylacetamide. The solution was then pushed hydraulically into a spin cell similar to the one shown in FIG. 4 and spun through a single hole spinneret. The spinneret had a diameter of 0.004 inches (0.1016 mm) and a L/D ratio of 3.0. The air gap was 0.176 inches (4.47 mm) as measured from the outlet (3) of the spinneret to the narrowest diameter (or throat) of the aperture (12) of the nozzle (30) of the spin cell. The narrowest diameter of the aperture (12) was 0.062 inches (1.57 mm). The convergent wall of the aperture was at an angle of 40 degrees to the spinneret's axis making a conical angle of 80 degrees. Air heated to 80° C. and pressurized to 83 psig (6.9 kg/cm$^2$) was introduced into the spin cell as attenuating fluid. The discontinuous fibers leaving the spin cell were contacted with a spray of tap water at a distance of approximately 11 inches (28 cm) from the tip of the aperture (12) and collected over a moving screen. A web of subdenier fibers formed on the screen.

Alternatively, the discontinuous fibers leaving the spin cell were contacted with water at the tip of the aperture (12) and collected over a pool of water as explained in EXAMPLE 3. The product in this case

TABLE II

Poly(m-phenylene isophthalamide) Fibers

| Spinning Soln. | | Attenuating Air | | | | Average Fiber Properties (Averaged Over 8 Filaments) | | | | |
|---|---|---|---|---|---|---|---|---|---|---|
| Temp. °C. | Pressure Psig (kg/cm$^2$) | Temp. °C. | Pressure Psig (kg/cm$^2$) | Conveyor Belt Speed meters/min. | Air Jet Nozzle Diameter inches (mm) | Diameter Avg. Micrometers | Denier Avg. (dtex) | Avg. Tenacity gpd (dN/tex) | Init. Mod. Av. Kpsi (gpd) (dN/tex) | Max. Av. Elongation % |
| 25 | 600–1400 (43.2–99.5) | 77 | 75 (6.3) | 1.25–2.0 | 0.062 (1.57) | 4.28 | 0.171 (0.190) | 3.82 (3.37) | 1019 (60.4) (53.3) | 47.19 |

EXAMPLE 3

In this example, 160 grams of 20% solution of poly(m-phenylene isophthalamide) in dimethylacetamide was diluted with 40 grams of dimethylsulfoxide solvent. The mixture was pushed hydraulically into a spin cell similar to the one shown in FIG. 4 and spun through a single hole spinneret according to the conditions in Table II. The single hole spinneret had a diameter of 0.004 inches (0.1016 mm) and a L/D ratio of 3.0. The spin cell had an air-gap of 0.176 inches (4.47 mm) as measured from the outlet (3) of the spinneret to the narrowest diameter (or throat) of the aperture (12) of the nozzle (30) of the spin cell. The narrowest diameter of the aperture (12) was 0.062 inches (1.57 mm). The convergent wall of the aperture was at an angle of 40 was subdenier pulp which can be used, for example, in paper making, in asbestos replacement, or as a bonding agent between layers of poly(p-phenylene terephthalamide) for high temperature applications.

EXAMPLE 5

A 20% solution of a polymer blend of 70% poly(m-phenylene isophthalamide) and 30% of a copolymer of 3,4'-diaminodiphenyl ether and isophthaloyl- bis-(caprolactam) was prepared in dimethylacetamide. The solution was then spun using a spin cell similar to the one shown in FIG. 4, having a single-hole spinneret with a diameter of 0.004 inches (0.1016 mm). The same solution was also spun using the same spin cell, but with a spinneret having a diameter of 0.010 inches (0.254 mm). Both spinnerets had a L/D ratio of 3.0. The spin cell had an air gap of 0.125 inches (3.175 mm) as measured from the outlet (3) of the spinneret to the narrowest diameter (or throat) of the aperture (12) of the nozzle (30) of the spin cell. The narrowest diameter of the aperture (12) was 0.062 inches (1.57 mm). The convergent wall of the aperture was at an angle of 40 degrees to the spinneret's axis making a conical angle of 80 degrees. Heated air at 90° C. and 60 psig (5.3 kg/cm$^2$) was introduced into the spin cell as attenuating fluid.

The discontinuous fibers leaving the spin cell were contacted with a spray of tap water at the tip of the aperture (12) and collected over a pool of water as explained in EXAMPLE 3. The fibers were then filtered, washed and dried. The product was pulp-like short fibers which can be used as a replacement for asbestos or as bonding agents. Thin filter cakes of the pulp-like short fibers were hot pressed at about 260° C. to form non porous membranes.

EXAMPLES 6–16

The pulp-like fibrids used in these examples were prepared as follows. A 19% solution of poly(m-phenylene isophthalamide) indemithylacetamide was diluted to 16% solids with dimethylsulfoxide. The solution was spun at 25° C. through a 0.004 inch (0.102 mm) single hole spinneret having a L/D ratio of 3. The spin cell was similar to that depicted in FIG. 6 and had an air-gap of 0.155 inch (3.94 mm), as measured from the outlet (103) of the spinneret to the outlet of the aperture (130), which had a diameter of 0.062 inches (1.575 mm), and a length of 0.062 inches (1.575 mm). The spinning solution pressure was 28.1 kg/cm$^2$ (400 psig) and the attenuating air pressure was 5.2 kg/cm$^2$ (74 psig).

The discontinuous fibers leaving the spin cell were contacted with a spray of tap water at the tip of the aperture (130) and collected over a pool of water. The fibers were then washed with water in a home blender several times to remove solvent (final dimethylacetamide content was 0.16% with no detectable dimethylsulfoxide present) The fibers obtained were in the form of pulp-like fibrids.

Fibrid quality was evaluated by blending at 0.04 weight % solids in distilled water for about one minute at high speed in a home kitchen blender. The high quality fibrids were easily separated in the blender and stayed uniformly dispersed in water without clumping. The aqueous dispersions were cast into tissue-thin handsheets (3–4 g/m$^2$), dewatered, and dried. The sheets were examined for clumps of pulp. The sheets were found to be fine and uniform with few or no clumps, which is indicative of high quality pulp-like fibrids. Clumps can be knotted filaments or solid polymer that has escaped fibrillation during spinning.

Fibrid diameters measured using scanning electron microscopy were 1–20 micrometers with very few particulate defects. An average length for the pulp-like fibrids of 0.47 mm was determined by the Kajaani method. The pulp-like fibrids had a freeness of 773 ml measured on a Schoppler Riegler apparatus.

Prior to preparation of sheets, the pulp-like fibrids were opened by putting the total weight required of wet-lap pad into an ordinary 1 quart household blender that was approximately ¾ filled with water and blending at medium speed for 1–2 minutes so that no lumps or strings were present. A total of 2.8 g of ingredients were used to make nominal 2.0 oz/yd$^2$ basis weight, 8 by 8 inch sheets. Handsheets comprised of the pulp were cast in a standard Deckle box. The pulp-like fibrids (supplied in dilute slurry form) were gently mixed in the Deckle box with 10 liters of water. A vacuum was applied, allowing the sheet to be formed on a removable wire screen. Further dewatering took place by lightly pressing the sheet and wire screen between two layers of blotter paper, using a Noble and Woods sheet press. The wire screen was peeled away and replaced by a fresh sheet of blotter paper, the sheet sandwich pressed again, and then the sheet was removed and allowed to dry between fresh layers of blotter paper.

The pulp-like fibrids (P) were used alone or in combination with poly(m-phenylene isophthalamide) filmy fibrids (F) and/or poly(m-phenylene isophthalamide) staple floc (S). The filmy fibrids were prepared according to the procedure disclosed in Gross, U.S. Pat. No. 3,756,908, the disclosure of which is hereby incorporated by reference, and had a Kajaani average length of 0.25 mm and Schoppler Riegler freeness of 330 ml. The staple floc was prepared according to the procedure disclosed in Alexander, U.S. Pat. No. 3,133,138, the disclosure of which is hereby incorporated by reference, and had a cut length of 6 mm and was 2 denier per filament.

The pulp-like fibrids, filmy fibrids, and/or staple floc were mixed together in the Deckle box prior to application of the vacuum. Samples of the sheets were hot-pressed for 1 min at 1000 psi on a Farrel Watson-Stillman press, Model No. 9175-MR. The sheets were tested for basis weight, dielectric strength, porosity, elongation-to-break (Elong-b), modulus, and density. Sheet properties are reported in Table III below.

TABLE III

| EXAMPLE | COMPOSITION (WT %) P | F | S | BASIS WT oz/yd2 | Dielectric Strength (V/oz/yd2) PRESSED | Elong-b (%), PRESSED | Modulus (kpsi) PRESSED | Density (g/cc) PRESSED |
|---|---|---|---|---|---|---|---|---|
| 6 | 100 | 0 | 0 | 0.7 | 666 | 80.3 | 2 | 0.38 |
| 7 | 100 | 0 | 0 | 1.0 | 566 | 53.5 | 8 | 0.44 |
| 8 | 100 | 0 | 0 | 2.5 | 346 | 1.2 | 69 | 0.63 |
| 9 | 33 | 33 | 33 | 2.0 | 677 | 5.7 | 198 | 0.64 |
| 10 | 75 | 25 | 0 | 2.2 | 340 | 4.1 | 90 | 0.67 |
| 11 | 25 | 0 | 75 | 2.1 | 333 | 0.8 | 97 | 0.56 |
| 12 (Comparative) | 0 | 25 | 75 | 2.1 | 560 | 3.5 | 137 | 0.54 |
| 13 (Comparative) | 0 | 50 | 50 | 0.9 | 768 | 5.4 | 110 | 0.40 |
| 14 (Comparative) | 0 | 50 | 50 | 2.2 | 762 | 6.6 | 164 | 0.63 |
| 15 | 60 | 0 | 40 | 2.2 | 318 | 1.7 | 148 | 0.65 |
| 16 (Comparative) | 0 | 100 | 0 | ≧0.5 | — | — | — | — |
| | COMPOSITION | | | | POROSITY | POROSITY | | PRESSING |

TABLE III-continued

| EXAMPLE | (WT %) P | F | S | UNPRESSED (sec/100 cc) | PRESSED (sec/100 cc) | TEMPERATURE (degrees) |
|---|---|---|---|---|---|---|
| 6 | 100 | 0 | 0 | 0.2 | 0.3 | 260 |
| 7 | 100 | 0 | 0 | 0.2 | 0.4 | 260 |
| 8 | 100 | 0 | 0 | 1.0 | 3.2 | 279 |
| 9 | 33 | 33 | 33 | 112.1 | >1800 | 279 |
| 10 | 75 | 25 | 0 | 56.6 | >1800 | 279 |
| 11 | 25 | 0 | 75 | 0.1 | 0.2 | 279 |
| 12 | 0 | 25 | 75 | 0.5 | 126.8 | 279 |
| 13 | 0 | 50 | 50 | 104.4 | 297.6 | 260 |
| 14 | 0 | 50 | 50 | 583.1 | >1800 | 279 |
| 15 | 60 | 0 | 40 | 0.2 | 0.8 | 279 |
| 16 | 0 | 100 | 0 | >1800* | >1800* | — |

*estimated values

The benefits of adding pulp-like fibrids is clearly established by this data. Example 13, with 50 wt. % filmy fibrids and 50 wt. % staple floc, is representative of compositions of commercially available papers.

Comparing Examples 6 and 7 with Example 13, note the dramatic increase in porosity for Examples 6 and 7 which is accompanied by good dielectric properties. Furthermore, it should be noted that the papers of Examples 6 and 7 have high elongation and low modulus when compared to those of Example 13. The high elongation and low modulus, i.e., high flexibility, is an advantage for certain applications which require winding the paper. However, because these papers are also highly porous, they can be saturated with resins or varnishes to make them more rigid. Therefore, these papers have better versatility. Saturation with resins or varnishes is also well known in the art as a method of improving mechanical and electrical properties. Example 9 illustrates a ter-blend of pulp-like fibrids, filmy fibrids, and floc with improved porosity and dielectric strength. These benefits can be obtained with 33% pulp-like fibrids, 33% filmy fibrids, and 33% floc concentration. However, the filmy fibrids tend to act against the porosity advantage introduced by the pulp-like fibrids (See, Examples 10, 14 and 16).

Porosity in unpressed sheets is a useful indicator of porosity in pressed sheets, especially when porosity in the pressed sheets is very low (high porosity values, i.e., greater than 1800 seconds). It would be inconvenient or impractical to run a porosity experiment for such a length of time. In addition, for sheets having high porosity (low porosity values, i.e., less than 0.1 seconds), the porosity readings may be controlled by the practical ability to make time measurements at these points.

Comparing Example 11 with Example 12 illustrates that porosity benefits can be obtained by replacing the filmy fibrids in a 25% filmy fibrid/75% floc sheet with 25% pulp-like fibrids. Dielectric strengths above about 200 are commercially significant and for papers with high porosity, these values can be raised by saturation with resins and varnishes.

Example 15 also shows the porosity benefits obtained when pulp-like fibrids are added.

We claim:

1. A process for preparing subdenier fiber from isotropic polymer solutions comprising 1) extruding a stream of an isotropic solution of a polymer through a spinneret orifice into a chamber, 2) introducing a pressurized gas into said chamber, 3) directing the gas in the flow direction of and in surrounding contact with said stream within the chamber, 4) passing both the gas and stream through an aperture into a zone of lower pressure at a velocity sufficient to attenuate the stream and fragment it into fibers, and 5) contacting the fragmented stream in said zone with a coagulating fluid.

2. A process according to claim 1, wherein the polymer in solution is polyacrylonitrile.

3. A process according to claim 1, wherein the polymer in solution is poly(m-phenylene isophthalamide).

4. A process according to claim 1, wherein the polymer in solution is a copolymer of 3,4'-diaminodiphenyl ether and isophthaloyl-bis-(caprolactam).

5. A process according to claim 1, wherein the polymer in solution is a mixture of poly(m-phenylene isophthalamide) and a copolymer of 3,4'-diaminodiphenyl ether and isophthaloyl-bis-(caprolactam).

6. A process according to claim 1, wherein the zone of lower pressure is air at atmospheric pressure.

7. A process according to claim 1, wherein the gas in contact with the extrudate in the chamber is air.

8. A process according to claim 1, wherein the subdenier fiber is collected in the form of fibers, rovings, or nonwoven mats.

9. A process according to claim 1, wherein the coagulating fluid is selected from the group consisting of water, dimethylsulfoxide, and dimethylacetamide.

10. A product produced by the process of claim 1.

11. A product produced by the process of claim 8.

12. The process of claim 1, wherein the polymer solution comprises about 12 to 19% by weight poly(m-phenylene isophthalamide) and the gas is air having a pressure equal to or greater than about 6 $Kg/cm^2$.

13. The process of claim 12, wherein the polymer solution comprises about 12 to 19% by weight poly(m-phenylene isophthalamide) in dimethylacetamide solvent.

14. The process of claim 12, wherein the polymer solution comprises about 12 to 19% by weight poly(m-phenylene isophthalamide) in a mixed solvent of dimethylacetamide and dimethylsulfoxide.

15. A pulp-like fibrid, produced by the process of claim 12.

16. A pulp-like poly(m-phenylene isophthalamide) fibrid having a diameter of about 0.1 to 50 micrometers, a length of about 0.2 to 2 millimeters, and a freeness value of about 100 to 2000 milliliters, said fibrid capable of forming 100% by weight poly(m-phenylene isophthalamide) porous sheets.

17. The pulp-like poly(m-phenylene isophthalamide) fiber of claim 16, wherein said sheets have a porosity of about 0.1 to 200 seconds per cubic centimeters.

18. A wet-laid sheet consisting of the fibrids of claim 16 and characterized by a dielectric strength equal to or greater than about 300 volts per ounce per square yard, and a porosity of about 0.1 to 200 seconds per 100 cubic centimeters.

19. A wet-laid sheet consisting of the fibrids of claim 16 and characterized by a dielectric strength equal to or greater than about 300 volts per ounce per square yard, and a porosity of about 0.1 to 2.0 seconds per 100 cubic centimeters.

20. A wet-laid sheet comprising about 5 to 95% by weight of the fibrids of claim 16 and characterized by a dielectric strength equal to or greater than about 300 volts per ounce per square yard, and a porosity of about 0.1 to 200 seconds per 100 cubic centimeters.

21. A wet-laid sheet comprising about 5 to 95% by weight of the fibrids of claim 16 and characterized by a dielectric strength equal to or greater than about 300 volts per ounce per square yard, and a porosity of about 0.1 to 2.0 seconds per 100 cubic centimeters.

22. A wet-laid sheet comprising a composition of the fibrids of claim 16, poly(m-phenylene isophthalamide) film-like fibrids, and poly(m-phenylene isophthalamide) staple and characterized by a dielectric strength equal to or greater than about 300 volts per ounce per square yard, and a porosity of about 0.1 to 200 seconds per 100 cubic centimeters.

* * * * *